United States Patent [19]

Keraus et al.

[11] 3,967,553

[45] July 6, 1976

[54] FLAMMABILITY PROMOTING AMMUNITION FOR USE AGAINST AIRBORNE TARGETS

[75] Inventors: Roman Keraus, Purten; Gerhard Schulz, Frasshausen; Caspar von Münchhofen, Oberhaching; Heinrich Hofmann, Grobenzell, all of Germany

[73] Assignee: Messerschmitt-Bőlkow-Blohm GmbH, Munich, Germany

[22] Filed: July 23, 1974

[21] Appl. No.: 491,165

[52] U.S. Cl. ..... 102/66; 102/56 SC; 102/67; 102/90

[51] Int. Cl.[2] ..... F42B 13/12; F42B 13/14; F42B 13/18

[58] Field of Search ..... 102/6, 24 HC, 66, 67, 102/90, 56 SC

[56] References Cited

UNITED STATES PATENTS

| | | | |
|---|---|---|---|
| 1,306,215 | 6/1919 | Cushing | 102/67 |
| 3,135,205 | 6/1964 | Zwicky | 102/24 HC |
| 3,292,543 | 12/1966 | Tisch | 102/66 |
| 3,557,698 | 1/1971 | Hart et al. | 102/90 X |
| 3,570,401 | 3/1971 | Euker | 102/66 |
| 3,572,249 | 3/1971 | Davis | 102/67 |

*Primary Examiner*—Verlin R. Pendegrass
*Attorney, Agent, or Firm*—Toren, McGeady and Stanger

[57] ABSTRACT

In a round of ammunition particularly intended for use against airborne targets, such as aircraft, explosive material and oxygen releasing carrier material are arranged within a casing, preferably in a number of layers, with at least a portion of the materials arranged for detonation under time delay, for increasing the flammability of the target. To increase the likelihood of damage of the target, the casing is arranged to splinter and splinter forming materials can be incorporated into one or more of the layers. In addition, to further promote the flammability to the target, material to support and enhance flammability is incorporated into the material within the casing.

11 Claims, 5 Drawing Figures

FLAMMABILITY PROMOTING AMMUNITION FOR USE AGAINST AIRBORNE TARGETS

SUMMARY OF THE INVENTION

The present invention is directed to ammunition for use against airborne targets, such as airplanes and the like, and, more particularly, it concerns the incorporation of oxygen releasing carrier material within the ammunition which reacts with the fuel or combustible material in the target for promoting flammability.

When artillery is used in combating airplanes, particularly if rapid-fire guns are utilized, different types of ammunition, such as explosive, high-explosive armor-piercing, and incendiary projectiles are arranged in a certain order to be fed into the weapons being fired. The explosives employed are highly explosive materials for producing high-speed showers of splinters having sufficient penetration power. Since airplanes carry not only large amounts of fuel and other combustible material, but consist in themselves of an appreciable amount of combustible or reactive materials, great emphasis is placed on the incendiary effect in achieving the destruction of a target. While the gas shock of the detonating projectiles plays a certain part, its effect is mostly overestimated in a thorough evaluation of the problems involved, as will be noted from the following observations.

When a round of ammunition strikes a target, we distinguish between the gas shock effect, the fragmentation effect and the incendiary effect produced. Due to the smaller caliber of the projectiles employed, the gas shock effect is generally not sufficient to break or destroy wings, fuselage or engine of the airplane, because of the limited amount of explosive. the fragmentation effect alone does not always lead to the complete destruction of the airplane, since the components of the airplane whose failure would lead to its destruction, represent only a small percentage of the total volume of the plane. Experience has shown that planes exposed to the fragmentation effect alone often are able to return to their base or at least to a safe landing area. However, rapid destruction of an airplane is accomplished if it is set on fire, since it is rarely possible to extinguish a fully blazing fire. Though an airplane has sufficient combustible material to support a fire, the problem still exists for anti-aircraft guns to ignite the material. Such ignition is possible only if the fuel and oil on board, such as propellents and lubricants, are caused to flow from their containers and pipes by the explosion of a shell or projectile so that ignition is caused by flow over hot engine parts or by incendiary elements in the shell. It is not always possible to score a direct hit against the engine of an aircraft, moreover, the engines are thermally insulated from the airframe cell. Furthermore, engine fires can be "starved" by releasing the so-called quick-stop, that is, by pumping the engine lines empty by means of the engine, which runs out by itself due to its inertia (when the burning engine is cut off by the pilot). Otherwise the fuel pipe lines and fuel tanks are sufficiently insulated or protected at the airframe side. It is particularly disadvantageous that the gas shock produced by the detonation of the explosive and producing low oxygen or inert gas clouds which displaces the air at the point of impact and, as a result, also displaces oxygen at the decisive moment of impact, and even if additional explosive is supplied, either no fire results or one of extremely short duration which is quenched by the impact force. Further, a direct hit in the fuel tank does not guarantee that a fire will develop. If the tank is full, ignition is practically impossible, and if the tank is half full, the degree of fuel saturation above the level in the tank is such that ignition can hardly be ensured. In summary, it can be stated that even at the present time the most reliable way of destroying an airplane, namely, by setting it on fire, is only possible with a certain degree of probability with the known types of ammunition used against an airborne target.

Therefore, it is the primary object of the present invention to provide a type of ammunition which increases the likelihood of flammability of an airborne target if it is struck. In the present invention, the increased probability of flammability is provided by the use of oxygen releasing carrier material which releases oxygen when one or several explosive charges are detonated as a shell or round of ammunition strikes a target.

Though shells are known for combatting dirigibles filled with hydrogen gas, as disclosed in German Pat. No. 206,983, which contain, in addition to the explosive, oxygen which reacts with the hydrogen gas excaping from a hit target, this possibility is only of theoretical value, since the production and especially the storage of such shells and maintaining them ready for combat, is technically extremely difficult and the intended effect can hardly be achieved against a target.

In accordance with the present invention, the following substances are preferably used as oxygen releasing carriers: sodium nitrate ($NaNO_3$) and/or potassium nitrate ($KNO_3$) and/or potassium chlorate ($KClO_3$) and/or potassium perchlorate ($KClO_4$) and/or potassium permanganate ($KMnO_4$), which release free oxygen during the detonation of the explosive due to the action of heat and pressure.

In particular, the invention takes into account the situation when a target is hit for promoting flammability of the combustible material in the target by affording an oversupply of oxygen released from the ammunition during detonation for ensuring reaction and incendiary centers. Additionally, it is advisable to equip the ammunition with splinters or splinter forming material for piercing and damaging the target and also with flammability promoting material which ensures ignition and enhancement of the incendiary centers with a high degree of reliability.

A special problem solved by the invention involves the manner in which the ammunition, after its detonation, (within the target, against the target, and before or during its flight over the target) provides splinters, oxygen releasing carriers and flammability producing material which acts against the target not only with each other but also in a time delay manner. In other words, after a round of ammunition has been detonated by a part of its explosive material, initially splinters are generated which pierce or damage the target, then with a time delay oxygen is released by the oxygen releasing carriers by another part of the explosive and, if necessary, additional splinters are generated, and finally the inflammability promoting material is released with, if necessary, additional oxygen releasing carrier.

Such an arrangement of the ammunition enhances not only the local destruction which takes place at the point of contact on the target, but also the chronological destruction, as can be seen from the following situation:

1. The round of ammunition strikes the surface of the airplane target at $t = 0$ and ignites the fuse.

2. Detonation of the explosive material after an unavoidable delayed ignition of about $t = 1.10^{-4}$ seconds which occurs after the round or shell has penetrated about 1 to 15 cm into the airplane.

3. The splintering action takes place with the splinters hitting the airplane parts after about $2.10^{-4}$ seconds.

4. Due to the impact and/or the splintering action, fuel or other combustible materials escape and form an inflammable mixture either alone or in combination with the oxygen released from the ammunition, after $t > 6.10^{-3}$ seconds.

5. Ignition of this inflammable mixture by splinters heated by reaction with the oxygen andd particularly by the longer burning flammability producing material, takes place after more than $2.10^{-2}$ seconds and less than 1 second.

In accordance with the invention, a portion of the explosion and fragmentation effect, measured by the fixed volume and weight of the shell, is given up in place of a positive oxygen balance. In addition, due to the special arrangement of the various materials used within the individual rounds of ammunition, there is a controlled production of fire in the target. A determining feature in producing such controlled production is that the oxygen supply and the period set for ignition occur only after the gas shock which is required to produce the splinter shower and fragmentation force.

The material for supporting flammability consists of particles whose size and heat capacity are such that their surface temperature is sufficient to ignite the incendiary centers even at least at 1/10 of a second after the detonation of the shell. Particles of iron, aluminum, magnesium and zirconium having a size in the millimeter range, as well as thermite mixtures can be used as the flammability supporting material. Further, these substances can be incorporated into the shell casing or form parts of the casing.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there are illustrated and described preferred embodiments of the invention.

DETAILED DESCRIPTION OF THE INVENTION

Figure 1:
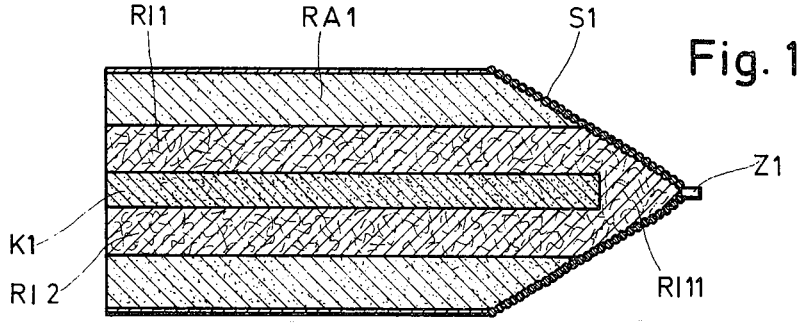
FIGS. 1 — 5 are longitudinal sectional views, each of a different embodiment of a shell or round of ammunition incorporating the present invention.

In FIG. 1, the round of ammunition has a cylindrical casing with a conically shaped head. The conically shaped head is formed of a number of pre-shaped splinters S1 and a percussion fuse Z1 is located at the apex of the cone. The interior of the casing and head is filled with material and consists of an outer ring RA1 consisting of oxygen releasing carrier material, with the outer ring extending radially inwardly from the inner surface of the casing and its head. Inwardly of the outer ring and in contact with its inner surface is an inner ring RI1 formed of explosive material and having a headpiece

RI11 forming a closure extending transversely across the ring at the head end of the shall. Centered within the inner ring and terminating at the rearward end of the headpiece of the inner ring is a core K1 of oxygen releasing carrier material.

Figure 2:
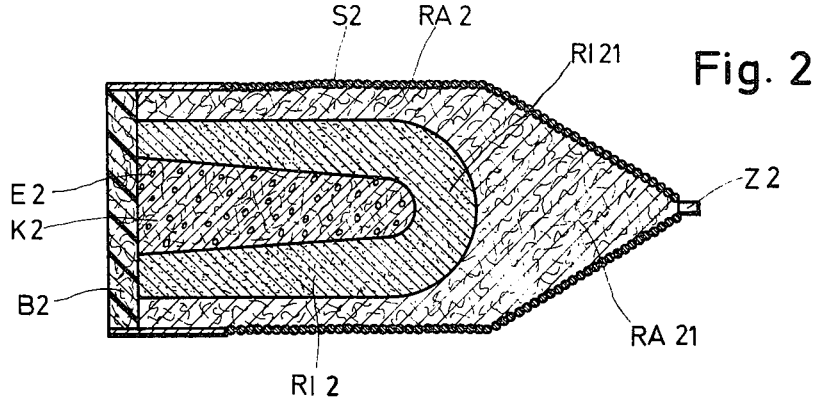

In FIG. 2, a shell or round of ammunition similar to the one shown in FIG. 1 is illustrated, however, not only is its conical head formed of pre-shaped splinters S2, but a considerable portion of the cylindrical casing extending from the conical head toward the rearward end of the shell is also formed of the pre-shaped splinters S2. The interior of the shell is filled with material which includes an outer ring RA2 extending approximately for the axial length of the cylindrical casing and provided with a transversely extending headpiece RA21 which fills the conical head of the shell. The outer ring and its headpiece consists of explosive material. Radially inwardly of and in contact with the inner surface of the outer ring RA2 is an inner ring RI2 which extends approximately for the length of the cylindrical casing and terminates at its forward end in the headpiece RI21 which extends transversely across the inner ring. The inner ring and its headpiece are formed of oxygen releasing carrier material. Extending coaxially with the casing within the inner ring RI2 is a core K2 of explosive material which extends between the base of the shell and the rearwardly facing surface of the headpiece RI21. A percussion fuse Z2 is positioned at the apex of the conically shaped head and effects the detonation of the outer ring RA2, with the detonation wave, while throwing off the individual splinters S2, extending toward the base B2 of the shell which is formed of a delay material for providing a time delay of the detonation of the explosive core K2. Due to the delayed detonation of the core K2, which trails timewise the explosion of the outer ring RA2, the oxygen releasing carrier material in the inner ring RI2 and its headpiece RI21 are thrown outwardly together with flammability producing material E2 in the direction of the structural parts of the target.

Figure 3:
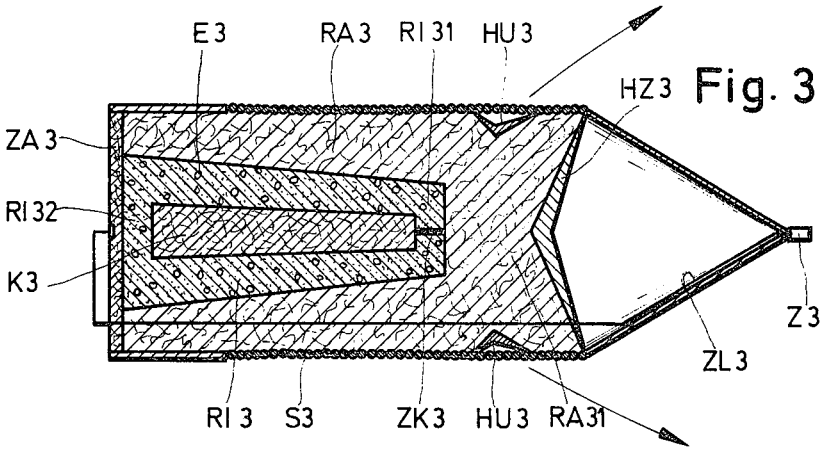

In FIG. 3, another round of ammunition is shown similar in general configuration to those in FIGS. 1 and 2 but having a hollow conically shaped head within the casing. At the base of the conically shaped head within the casing, a hollow charge HZ3 is provided and just rearwardly of it in contact with the inner surface of the casing is a circumferentially extending hollow charge HU3, with both of the hollow charges arranged to form, when detonated, projectiles. A major portion of the cylindrically shaped casing extending rearwardly from the head is formed of a splinter jacket of pre-shaped splinters S3. Within the cylindrically shaped casing between the hollow charge HZ3 and the base of the casing is an outer ring RA3 having a transversely extending headpiece RA31, all formed of an explosive material. The outer ring RA3 and its headpiece RA31 is detonated in a known manner at the base of the casing by an induced detonation charge ZA3. A firing circuit ZL3 is connected to a percussion fuse Z3 at the apex of the conical head of the shell and extends rearwardly to the detonation charge ZA3. Radially inwardly of the outer ring is an inner ring RI3 with a headpiece RI31 and a base piece RI32, extending transversely of the axis of the casing and forming, in combination with the ring, a closed member. The inner ring RI3 along with its head and base pieces are formed of the oxygen releasing carrier material along with flammability producing material E3. Encased within the inner part and its head and base pieces is a core K3 formed of explosive material, which is detonated under a time delay by a detonation passage ZK3 filled with a detonation-retarding material.

Figure 4:
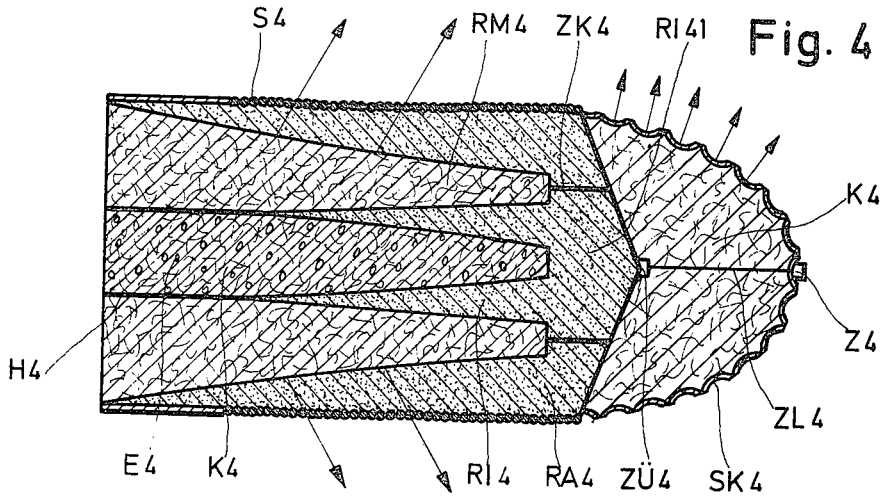

In FIG. 4, the shape of the round of ammunition differs somewhat from that in FIGS. 1 – 3 in that the head is rounded rather than conical. The rounded head is formed of pre-shaped splinters SK4 and the splinters have a rounded or arcuate shape and are arranged to provide a substantially hemispherical splinter shower upon detonation. The interior of the head is filled with an explosive charge K4. A substantial portion of the casing of the shell extending rearwardly from the head is formed by a splinter jacket S4. Within the casing extending rearwardly from the trailing end of the head is an outer ring RA4 and an inner ring RI4 formed of the oxygen releasing carrier material. Extending from the base of the casing toward but spaced from the trailing end of the head is an intermediate ring RM4 formed of explosive material. An inner core K4 also formed of explosive material extends from the base of the casing toward the head. Flammability producing material E4 is incorporated into the core K4. The surfaces of the intermediate ring RM4 and the core K4 taper inwardly from the base toward the head of the casing.

The method of the operation of the invention will now be described in detail with regard to the embodiment shown in FIG. 4, however, the sequence of the operations in the other embodiments is similar. After the response of an induced detonation charge ZU4 positioned at the base of the explosive charge K4 within the head, which is initiated from the percussion fuse Z4, though any other type of fuse, like a proximity fuse could be used, the explosive charge K4 is detonated. Due to its detonation, a shower of splinters SK4 spreads in a hemispherical pattern and can be assumed to damage any parts of the airplane formed of or containing combustible material, such as fuel pipes. Because of the resulting gas shock, with its inert clouds, which initially displace the atmospheric oxygen in the region of impact, there is practically no possibility of igniting a fire during the first moments after impact. After the detonation of the explosive charge K4 within the head, the intermediate ring RM4 is detonated over the detonation passages ZK4, with the detonation wave front extending from the front to the rear. The oxygen releasing carrier material is thrown outwardly from the outer ring RA4 toward the impact points of the splinters SK4. At the same time, the pre-shaped splinters S4 in the cylindrically shaped portion of the casing are caused to glow by the resulting heat and reaction with the released oxygen and ignite the mixture of combustible material or fuel and oxygen formed at the impact points. The core K4, which is detonated under a time delay over an inhibition layer H4, assures flammability by providing additional oxygen contained in inner ring RI4 directed to the impact points of the combustible material and fuel. Further, the combustible fuel and oxygen mixtures are set on fire by the flammability producing material E4 whch is contained in the core K4 and distributed when the core is exploded. The ignition of the combustible fuel and oxygen mixtures is effected in a time interval between $2.10^{-2}$ and $1.10^{-1}$ seconds after the ignition of the fuse Z4 at the forward end of the head. As mentioned above, the flammability producing material burns for a considerable period of time, up to about $3.10^{-1}$ seconds, burning up due to the heat generated by the detonation of the explosive core K4.

Figure 5:
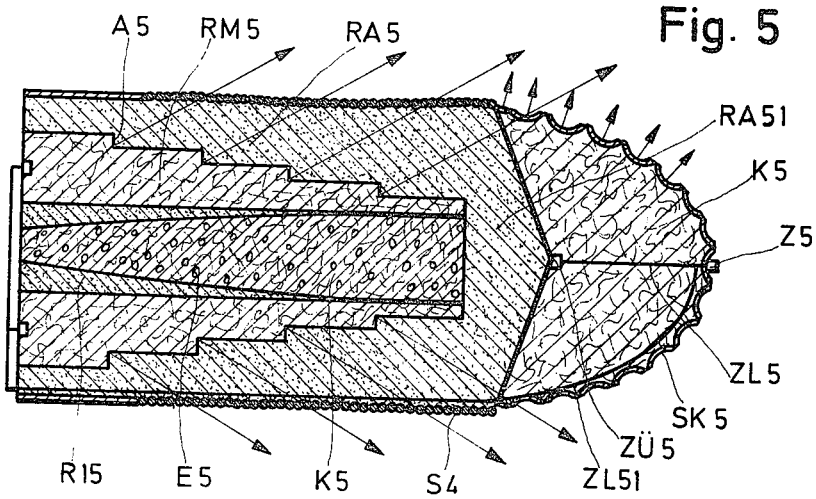

In FIG. 5, similar reference characters with the differentiating numeral 5 are used and correspond to the parts described in FIG. 4. However, in contrast to FIG. 4, the intermediate ring RM5 is detonated with a time delay over a line ZL51 from the rearward end of the casing. Due to this arrangement and the stepped formation A5 on the outer surface of the intermediate ring RM5, a forwardly directed ejection of the oxygen releasing carrier material is achieved, that is, in the direction indicated by the arrows which is in the impact direction of the splinters SK5. The induced detonation of the explosive material core K5 is effected in its forward region.

In FIG. 4, the core K4 tapers in the forward direction while in FIG. 5 the core K5 has its surfaces converging toward the base of the casing. The converging surfaces have a curved shape. Further, because of the curved shape, a layer R15 of oxygen releasing carrier material is provided between the core and the inner surface of the intermediate ring RM5.

Though the invention has been described with reference to a shell or round of ammunition, such as would be fired from an artillery piece, it can also be used in rocket-fired missiles and land and sea mines.

While specific embodiments of the invention have been shown and described in detail to illustrate the application of the inventive principles, it will be understood that the invention may be embodied otherwise without departing from such principles.

What is claimed is:

1. A round of ammunition, particularly for use against airborne targets, such as aircraft and similar targets, said round of ammunition comprising a casing capable of fragmenting into splinters, explosive material in the form of at least one explosive charge located within and capable of fragmenting said casing, oxygen for reaction with fuel or other combustible materials in the target, and material for supporting the flammability of combustible material located on or in the target, wherein the improvement comprises that said casing has a shaped head portion and an axially extending cylindrically shaped portion extending axially rearwardly from said head portion, a core of explosive material located within and extending in the axial direction of the cylindrically shaped portion of said casing, an inner ring-shaped body of oxygen releasing material laterally disposed about said core, an outer ring-shaped body of explosive material laterally enclosing said inner ring-shaped body, first means for igniting said outer ring-shaped body and second means within said casing for providing a delayed ignition of at least said core of explosive material relative to the ignition of said outer ring-shaped body.

2. A round of ammunition, as set forth in claim 1, wherein said first means includes a fuse located on the end of said head portion remote from said cylindrically shaped portion and said second means includes delay material located at the end of said cylindrically shaped portion spaced from said head portion.

3. A round of ammunition, as set forth in claim 2, wherein said second means also includes a firing circuit interconnecting said fuse and said delay material.

4. A round of ammunition, as set forth in claim 1, wherein said first means includes a fuse located on the end of said head portion remote from said cylindrically shaped portion, a detonation charge located at the opposite end of said cylindrically shaped portion from said head portion, and a firing circuit extending from said fuse to said detonating charge, said second means includes delay material for the delayed explosion of said core, and said inner ring-shaped body of oxygen releasing material includes said material for producing flammability.

5. A round of ammunition, as set forth in claim 4, wherein said head portion and said cylindrically shaped portion of said casing are capable of fragmenting and forming splinters.

6. A round of ammunition, as set forth in claim 1, wherein said shaped head portion of said casing being formed of shaped fragments, an explosive charge located within said head portion of said casing forwardly of said core and of said outer ring-shaped body of explosive, a fuse mounted in the end of said shaped head portion of said casing remote from the cylindrically shaped portion thereof, a detonation charge located at the end of said explosive charge closer to said cylindrical portion of said casing, an outer ring-shaped body of oxygen releasing carrier material laterally enclosing said outer ring-shaped body of explosivie material, said first means including firing means for exploding said outer ring-shaped body of explosive material after the explosion of said explosive charge in said head portion of said casing, and said material for supporting flammability being located within said core of explosive material.

7. A round of ammunition, as set forth in claim 1, wherein an explosive charge is located within said head portion of said casing forwardly of said core and of said outer ring-shaped body of explosive, a fuse mounted on the end of said head portion remote from said cylindrically shaped portion, a first detonation charge located on the end of said outer ring-shaped body of explosive material closer to said head portion, first delay member associated with said first detonating charge for delaying the explosion thereof relative to the explosion of said charge within said head portion, and a second detonation charge located on the end of said core of explosive material more remote from said head portion, and a second delay member associated with said second detonation charge for delaying the explosion of said core of explosive material after the explosion of said outer ring-shaped body of explosive material.

8. A round of ammunition, as set forth in claim 1, wherein said head portion of said casing is conically shaped, and a body of oxygen releasing carrier material positioned within said casing between the conically shaped said head portion and the adjacent end of said core of explosive material.

9. A round of ammunition, as set forth in claim 1, wherein a first detonation charge for said outer ring of explosive material is located at the end of said outer ring more remote from said head portion of said casing, said core of explosive material is frusto-conically shaped at least at its end more remote from said head portion of said casing, and said inner ring-shaped body extends from the end of said core more remote from said head portion to a location spaced rearwardly from the end of said core closer to said head portion.

10. A round of ammunition, as set forth in claim 1, wherein said outer ring-shaped body of explosive material includes a portion extending transversely across the axis of the cylindrically shaped portion of said casing and across the ends of said core and of said inner ring-shaped body closer to said head portion of said casing, and the surface of said transversely extending portion closer to said head portion of said casing is concave in shape.

11. A round of ammunition, as set forth in claim 1, wherein the outer surface of said outer ring-shaped body of explosive material extending in the axial direction of the cylindrically shaped portion of said casing has a stepped configuration with the steps thereof directed inwardly in the direction of said head portion of said casing.

* * * * *

UNITED STATES PATENT OFFICE

CERTIFICATE OF CORRECTION

Patent No. 3967553 Dated July 6, 1976

Inventor(s) Roman Keraus et al

It is certified that error appears in the above-identified patent and that said Letters Patent are hereby corrected as shown below:

In the heading of the Patent [30] should read as follows:

--[30] FOREIGN APPLICATION PRIORITY DATA

July 25, 1973 Germany.....P 23 37 690.1--.

Signed and Sealed this

Seventh Day of September 1976

[SEAL]

*Attest:*

RUTH C. MASON
*Attesting Officer*

C. MARSHALL DANN
*Commissioner of Patents and Trademarks*